United States Patent [19]

Bitton

[11] 4,108,582

[45] Aug. 22, 1978

[54] CASING FOR GEAR PUMP OR MOTOR

[75] Inventor: Georges Bitton, Oullins, France

[73] Assignee: Rexroth-Sigma, Venissieux, France

[21] Appl. No.: 747,936

[22] Filed: Dec. 6, 1976

[30] Foreign Application Priority Data

Dec. 16, 1975 [FR] France ..... 75 38554

[51] Int. Cl.[2] ..... F04C 15/02; B23P 15/00

[52] U.S. Cl. ..... 418/132; 29/156.4 R; 29/445

[58] Field of Search ..... 418/131, 132, 133, 206; 29/156.4 R, 156.4 WL, 445

[56] References Cited

U.S. PATENT DOCUMENTS

| | | | |
|---|---|---|---|
| 2,969,744 | 1/1961 | Hoffer | 418/132 |
| 3,292,551 | 12/1966 | Gordon | 418/132 |
| 3,395,646 | 8/1968 | Gelin | 418/133 |
| 3,481,275 | 12/1969 | Gelin | 418/133 |
| 3,597,130 | 8/1971 | Eckerle et al. | 418/133 X |
| 3,895,890 | 7/1975 | Laumont | 418/132 |

*Primary Examiner*—Carlton R. Croyle
*Assistant Examiner*—Leonard Smith
*Attorney, Agent, or Firm*—Larson, Taylor and Hinds

[57] ABSTRACT

A gear pump or motor comprises a tubular casing having an internal shoulder and an inlet and outlet for working fluid. A pair of meshing gearwheels are each mounted in the casing between a pair of rigid bearings which are disposed one on either side of the shoulder adjacent respective end plates closing the ends of the casing. Screws passing through the shoulder are provided for clamping the shoulder between the bearings and end plates. In an unclamped condition of the shoulder, the difference between the axial lengths of the shoulder and the gearwheels is greater than a predetermined operating clearance between the gearwheels and the bearings. In a clamped condition of the shoulder in the normal operating conditions of the pump or motor, the shoulder is resiliently deformed to reduce the said difference to a value at most equal to the predetermined clearance.

11 Claims, 4 Drawing Figures

CASING FOR GEAR PUMP OR MOTOR

BACKGROUND OF THE INVENTION

The invention relates to a volumetric machine gear pump or motor comprising a tubular casing, two end plates closing the axial ends of the casing, two rigid bearings received in the casing adjacent the respective end plates, meshing gearwheels each received between the two bearings, and means for balancing each bearing comprising a chamber defined between the bearing and the adjacent end plate and means for admitting to each chamber a fluid whose pressure increases with the delivery pressure of the pump or inlet pressure of the motor, an internal shoulder being provided on the casing between the bearings to limit the minimum distance between the proximate faces of the bearings to a value greater than the axial length of each gearwheel. The outer periphery of the bearings and recesses in the casing adapted to receive such bearings may be inter alia circular.

In a machine of the kind specified, to obtain a satisfactory performance the axial clearance between the gearwheels and the bearings during operation must be less than a predetermined limit. The limit is as a rule low and the machining accuracy of the various members of which the known volumetric machine is composed do not enable such demands to be systematically met. As a result, the various casings manufactured must be selected and matched with gearwheels whose dimensions are such as to meet the clearance requirement if satisfactory performance is to be achieved.

Moreover the performance of a machine of the kind specified depends considerably on the way in which the bearings supporting the gearwheels are balanced, since any deformation of the bearings, caused inter alia by hydraulic pressures developing during the operation of the machine, is accompanied by leakages which interfere with machine performance.

It is a main object of the invention to adapt a machine of the kind specified in such a way that it meets more satisfactorily the various practical requirements, inter alia so that its manufacture is simplified and its performance improved.

SUMMARY OF THE INVENTION

According to the invention, a volumetric machine of the kind specified is characterised by comprising means for mechanically clamping the internal shoulder of the casing between the bearings and the end plates, the shoulder having an axial length in an unclamped condition thereof such that the difference between the axial length of the shoulder and the axial length of each gearwheel is greater than a predetermined axial operating clearance; the clamping means exerting on said shoulder in the clamped condition thereof in the normal operating condition of the machine a force resiliently deforming the shoulder so that the said difference is reduced to a value at most equal to the said operating clearance.

It therefore becomes unnecessary to match the casing and gearwheels of the machine.

Preferably, the difference between the axial length of the inner shoulder of the casing in the unclamped condition and the axial length of each gearwheel is at least equal to seven hundredths of a millimeter, the predetermined operating clearance being less than seven hundredths of a millimeter, inter alia of the order of three hundredths to four hundredths of a millimeter.

Advantageously, the difference between the axial length of the shoulder in the unclamped condition and the axial length of each gearwheel and the clamping means are such that the maximum amplitude of the forces exerted on the clamping means via the end plates by the working fluid during operation of the machine is less than one third, more particularly less than one quarter of the initial clamping force. An arrangement of this kind gives the clamping means satisfactory fatigue resistance.

Preferably, the clamping means are formed by fasteners such as clamping screws extending through the end plates, the bearings and the shoulder.

The clamping means may comprise four screws, the shoulder comprising four holes through which the screws extend, the holes being disposed at the apices of a rectangle in four zones of the shoulder which are disposed on either side of the inlet and outlet of the casing, such zones forming solid parts of the shoulder having substantially the largest radial dimensions.

Advantageously the holes through which the clamping screws extend are so disposed as to be as far away as possible from the axes of the inlet and outlet of the casing, while maintaining adequate sealing tightness in relation to recesses in the shoulder for the gearwheels, inter alia while maintaining a minimum thickness of material between the holes through which the screws extend and the recesses for the gearwheels.

According to another feature of the invention, which is preferably used in combination with the preceding arrangements but can be used independently, a volumetric machine of the kind specified comprising circular bearings to support the gearwheels is characterised in that it comprises means for mechanically clamping the internal shoulder of the casing between the bearings and the end plates; said balancing means comprising a main chamber located on one side of an axial plane of the casing passing through the axes of the gearwheels; such main chamber comprising a substantially rectangular central zone portion and two opposed portions extending from said central portion; means connecting each main chamber to a pressurized zone on the said one side of the said axial plane; and sealing means bounding the periphery of each main chamber and clamped between the bearing and the adjacent end plate.

Advantageously, the balancing means comprises auxiliary chambers, inter alia of circular shape, located between bores in the bearings through which shafts of the gearwheels extend and the periphery of the bearings, adjacent the said axial plane, such auxiliary chambers being isolated from one another and each connected to that surface of the bearing which is adjacent the gearwheels via an axially extending channel.

Advantageously, two auxiliary chambers are located between each of the said bores of each bearing and the periphery of the bearing, the two auxiliary chambers being disposed one on either side of the said axial plane.

The chambers can be produced either by stamping the bearings, or by cut-outs in intermediate plates provided between the bearings and the end plates.

In the case of a motor it is advantageous to provide chambers which balance the hydraulic forces and are symmetrical in relation to the axial plane extending through the axes of the gearwheels, so that the motor can operate correctly in both directions of rotation.

The invention also relates to a method for making a geared volumetric machine of the kind specified.

In this method a tubular casing having an internal shoulder is provided; gearwheels are provided each for mounting in the casing between rigid bearings received in the casing adjacent to respective end plates, closing the axial ends of the casing; means are provided for mechanically clamping the shoulder of the casing between the bearings and the end plates; the axial lengths of the shoulder and each gearwheel is dimensioned such that the difference between the axial length of the shoulder in an unclamped condition and the axial length of each gearwheel is greater than a predetermined axial operating clearance between the gearwheel and the bearing; and the clamping means are actuated to clamp the casing shoulder to resiliently deform the shoulder so that said difference is reduced to a value at most equal to the said operating clearance.

Preferably, the clamping force is applied by the clamping means is controlled via the agency of means enabling displacement of the machine shaft to be followed during the clamping operation.

Apart from the arrangement set for above, the invention also has certain other features which will be more explicitly described hereinafter, in relation to an exemplary embodiment described with reference to the accompanying drawings.

Figure 1:
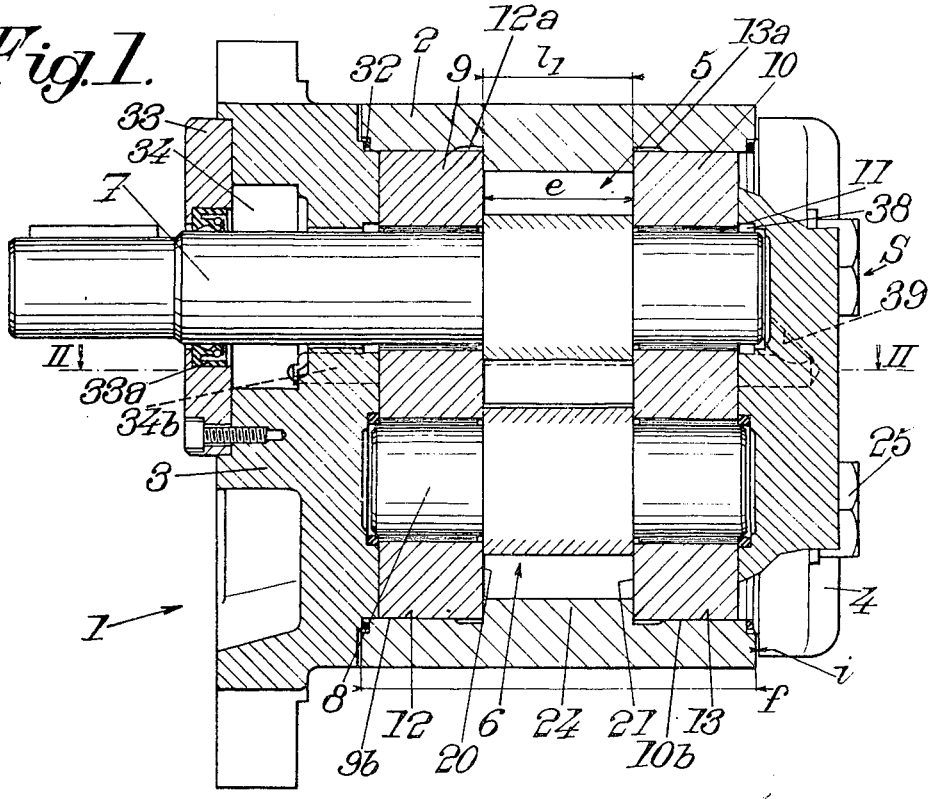
FIG. 1 is an axial section, with portions shown diagrammatically, of a machine according to the invention in the operative condition.
Figure 2:
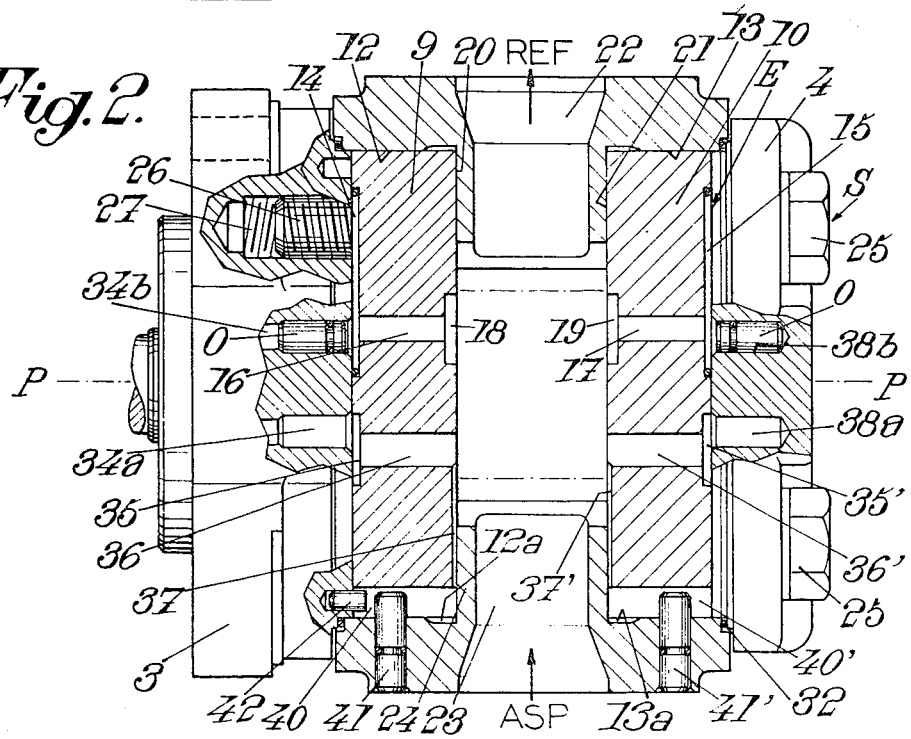
FIG. 2 is a section taken along the line II—II in FIG. 1.

Referring to the drawings, and more particularly FIGS. 1 and 2, a geared volumetric machine for liquids is shown, which will be supposed to be a pump, to facilitate the description, but which might be a hydraulic motor.

The pump 1 comprises a tubular casing 2, two end plates 3, 4 closing respective axial ends of the casing and two meshing gearwheels 5, 6 within the casing 2. The gearwheels 5, 6 are keyed for rotation with respective shafts 7, 8 supported on each side of the gearwheels by a rigid monobloc bearing 9, 10. Gearwheel 5 is inter alia unitary with the shaft 7. The shafts are borne by needle rollers 11 disposed in the bearings.

The shaft 7 projects out of the machine through the end plate 3, referred to hereinafter as the front plate, the plate 4 being the rear plate. The bearings 9, 10 (FIG. 4) are bearings with a circular outer periphery 9*b*, 10*b*. Recesses 12, 13 in the casing 2, adapted to receive the bearings 9, 10 also have circular inner contours. Hydraulic balancing means E are provided for each bearing, comprising a main chamber 14, 15 (FIGS. 2 and 4) defined between each bearing and the adjacent end plate 3, 4 respectively.

Means are provided for admitting to each chamber liquid taken from a delivery zone of the gearwheels 5, 6; the pressure of the liquid taken therefore increases with pump delivery pressure. These means comprise a duct 16, 17 (FIG. 2) extending axially through bearings 9, 10 respectively. The ducts 16, 17 discharge into respective circular recess 18, 19 provided in faces 20, 21 of the bearings which are adjacent the gearwheels. The ducts 16, 17 have their axes substantially aligned as shown in FIG. 2. Moreover, as can be seen from FIGS. 3 and 4, the ducts are situated on the same side as a pressurized aperture 22 of the machine in relation to an axial plane P extending through the axes of the gearwheels. In the case of the pump the aperture 22 is the outlet aperture; in the case of a motor the aperture 22 would be the inlet aperture. The other aperture 23 of the pump is the inlet aperture.

A shoulder 24 is provided inside the casing 2 between the bearings 9, 10 to limit the minimum axial distance separating the proximate faces 20, 21 of the bearings to a value greater than the axial length *e* of the gearwheels.

With the machine operating the clearance *j* existing between the faces of the gearwheels 5, 6 and the adjacent faces 20, 21 of the bearings must be smaller than a predetermined limit *h* to make the machine perform satisfactorily.

If the axial length of the shoulder 24 in the machine during operation is called $l_1$, and the axial length of the gearwheels 5, 6 is called *e*, we have the relation:

$$j = l_1 - e$$

For correct functioning we desire to have $$j \leqq h.$$

This value *h* is as a rule less than seven hundredths of a millimeter and inter alia of the order of three hundredths of a millimeter.

It is difficult to meet this condition in practice in known machines and as a rule the casings 2 and the gearwheels 4, 5 are matched. The casings 2 are classified in accordance with the measured axial length of their shoulder and the gearwheels in accordance with their mesh length *e*. A casing 2 and gearwheels 4, 5 are matched if their lengths meet the condition stated hereinbefore.

This is a considerable disadvantage of the known machines which the invention obviates or at least considerably reduces.

According to the invention the shoulder 24 of the casing 2 is given an axial length *l* such that, when the shoulder is in an unclamped condition the difference between the length *l* and the length *e* of the gearwheels is greater than the predetermined limit *h;* and the machine is provided with mechanical means S for clamping the shoulder 24 between the bearings 9, 10 and the end plates 3, 4, the clamping means S being devised to provide for exertion of a clamping force which is adapted to create a resilient deformation such that the difference $l - e$ between the axial length of the inner shoulder 24 and the axial length of the gearwheels 5, 6 is reduced to a value $l_1 - e$ at most equal to the predetermined limit *h*, such clamping force existing in the machine in its normal operating condition.

In FIGS. 1 and 2 it is assumed that the shoulder 24 is clamped and has a length $l_1$ less than its length *l* in the unclamped condition.

Figure 3:
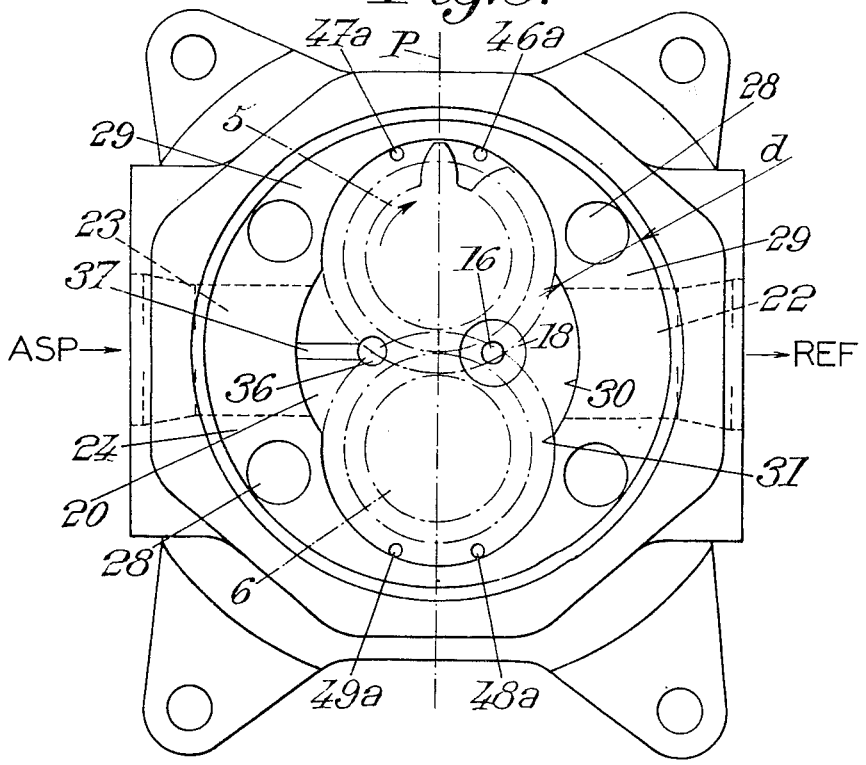
FIG. 3 is a right-hand view, in relation to FIG. 1, the rear end plate and the rear bearing of the machine being removed.

Preferably the difference $l - e$ between the length of the shoulder 24 before clamping and the length of the gearwheels 5, 6 is at least seven hundredths of a millimeter. The clamping means S advantageously take the form of screws 25 whose heads are visible in the right-hand part of FIGS. 1 and 2, such heads bearing against the end plate 4. In succession the screws extend through the plate 4, the bearing 10, the shoulder 24, the bearing 9; a screwthreaded end 26 of each screw 25 (FIG. 2) is screwed into a respective tapped hole 27 in the plate 3. The shoulder 24, as shown in FIG. 3, has four holes 28 through which the screws 25 extend. The holes are disposed at the apices of a rectangle in those zones 29 of the shoulder 24 which are disposed on either side of the inlet and delivery apertures 23, 22 of the machine. The zones 29 form solid parts of the shoulder which have substantially the largest radial dimensions *d* thereof.

As shown in FIG. 3, the shoulder 24 has a circular outer periphery and an inner periphery part of which corresponds to the substantially figure-of-eight outline formed by the two secant circular recesses adapted to receive the gearwheels 5, 6. A part-circular concave part 30 of the inner periphery of the shoulder 24 so connects, on each side of the plane P, the upper and lower parts of the figure-of-eight outline as to increase the inner opening of the shoulder 24 substantially at the level of the apertures 22, 23. The concave part 30 intersects the upper and lower parts of the figure-of-eight contour at points such as 31.

The holes 28 are placed as far as possible away from the axes of the apertures 22, 23, while maintaining adequate tightness relative to the circular recesses in which the gearwheels 5, 6 are disposed. To this end a minimum thickness of material is maintained between the holes 28 and such recesses. The holes 28 are advantageously substantially tangential to the inner wall of the recesses 12, 13 in the casing. The axial length *f* (FIG. 1) of the casing 2 is such that in the assembled machine — i.e., after the shoulder 24 has been clamped between the bearings 9, 10 by means of the screws 25 — a clearance *i* is left between each end face of the casing 2 and the adjoining end plate 3, 4. A sealing ring 32 is provided at each end of the casing 2 between the latter and the adjoining end plate to ensure that the plate hermetically seals the casing.

Extending through the front plate 3 is the output shaft 7 of the machine. A closure plate 33 having a lip joint 33*a* enclosing the shaft 7 is attached to the flange 3. An annular chamber 34 (FIG. 1) is formed around the shaft 7 between the closure plate 33 and end plate 3. Two ducts 34*a*, 34*b* (cf. FIG. 2) extend through the end plate 3 and place the chamber 34 into communication with that face of the end plate which is adjacent the bearing 9. The duct disposed on the same side of the plane P as the pressurized aperture — i.e., the duct 34*b* disposed on the same side of plane P as the delivery aperture 22 — is hermetically sealed by a closure element or plug *o*.

In the present instance, the other duct 34*a* remains open. That face of the bearing 9 which is adjacent the end plate 3 is formed with an annular recess 35 connected via a duct 36 to that face 20 of the bearing 9 which is adjacent the gearwheels. The face 20 is formed with a radial groove 37 (FIGS. 2 and 3) ensuring the return of liquid leakages to the intake aperture 23.

The duct 34*a* so discharges into the recess 35 that the liquid leakages which may have collected in the annular chamber 34 are evacuated to the inlet aperture. The pressure cannot therefore rise in the chamber 34 such an increase in pressure risking causing the deterioration of the joint 33*a*.

The other end of the shaft 7 is received in a cavity 38 in the end plate 4. Ducts 38*a*, 38*b* are provided to connect the cavity 38 to zones of that face 21 of the end plate 4 which is adjacent the bearing 10 (FIG. 2). The duct 38*b* in this instance, which is disposed on the same side of the plane P as the pressurized aperture 22, is closed by a closure element *o*. The other duct 38*a* discharges into a circular shoulder 35′ of the bearing 10 similar to the recess 35. The recess 35′ is connected to the inlet aperture 23 via a duct 36′ extending through the bearing 10 and the groove 37′ similar to the groove 37, provided in that face 21 of the bearing 10 which is adjacent the gearwheels. As can be seen in FIG. 1 each duct 38*a*, 38*b* comprises an axial blind bore starting from the inner face of the end plate 4; an inclined hole 39, discharging into the blind bore, connects the chamber 38 to the blind bore. This system of ducts enables any rise of pressure in the chamber 38 caused by operational leakages to be prevented. On either side of the shoulder 24 circular peripheral grooves 12*a*, 13*a* are provided in the wall of the recesses 12, 13 so as to ensure the recovery of the liquid leakages and their return to the intake, via the grooves 37, 37′. The grooves 12*a*, 13*a* form decompression means on either side of the inner shoulder 24.

Axially extending grooves 40, 40′ are provided in the bearings 9, 10 to cooperate with stubs 41, 41′ received in the casing 2 and projecting into the grooves, to ensure that the bearings are correctly positioned in relation to the casing.

Similarly, a stub 42 (FIG. 2) projects from the inner face of end plate 3 for engagement in the groove 40 in the bearing 9, thus ensuring that the flange is correctly positioned in relation to the bearing.

The clamping screws 25 are wide in dimension and the difference between the axial length *l* of the shoulder 24 of the casing before clamping and the axial length *e* of the gearwheels 4, 5 is so selected that the maximum amplitude of the forces exerted on the screws 25 via the end plates by the working liquid during operation of the machine is less than one third and more particularly less than one quarter of the initial clamping force.

By way of numerical example, a machine was made in which the mechanical clamping force ensured by each screw was of the order of 7350 decanewtons, while the hydraulic force which is transmitted to each clamping screw when the machine is operating is of the order of 1625 decanewtons for a delivery pressure of the order of 210 bars.

It therefore appears that the extra, variable forces due to variations in the pressure of the fluid in the machine, inter alia in dependence on whether the machine is under load or idling, are relatively low in relation to the initial stressing of the screw. The result is that the screws 25 have satisfactory fatigue resistance.

The previously described balancing means E for the bearings 9, 10 enable progressive balancing to be produced as the pressure of the delivered liquid rises. The balancing means comprise the aforementioned chambers 14, 15 which each form a main chamber of the equilibration means.

The chambers 14, 15 have a shape suitable for allowing the reduction or avoidance of deformations of the bearings due to hydraulic forces, while ensuring that such forces are satisfactorily balanced.

Figure 4:
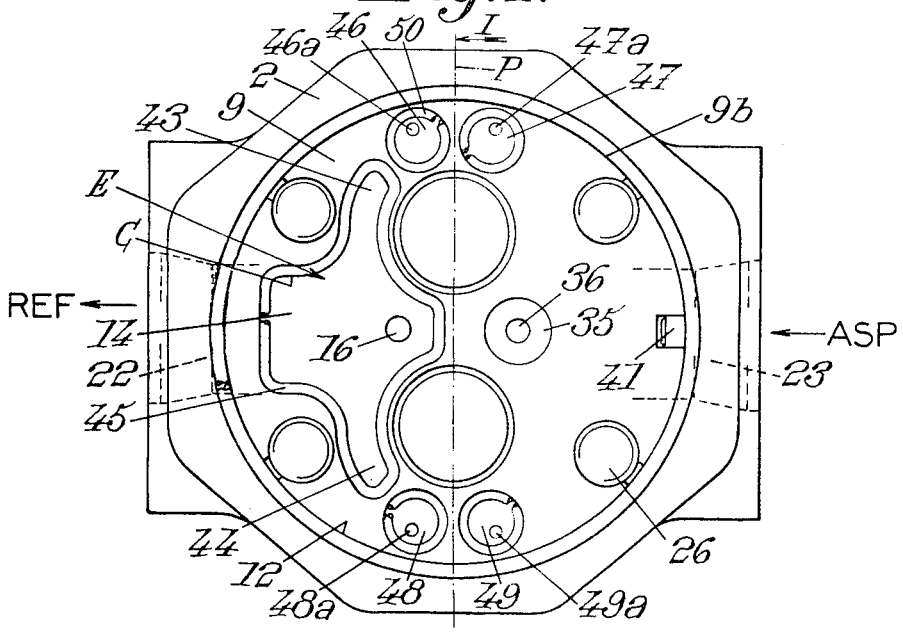
FIG. 4 is a left-hand view, in relation to FIG. 1, the front end plate having been removed.

To this end, as clearly seen in FIG. 4, the chambers 14, 15 are completely situated, relative to the plane P extending through the axes of the gearwheels, on the side of the pressurized aperture 22 of the machine, since the spaces between the teeth of the gearwheels in which the pressurized liquid is situated are mainly disposed on that side in relation to the plane P.

The outline C of the chamber 14 is clearly shown in FIG. 4. The chamber comprises a substantially rectangular central portion and two transverse extensions 43, 44 disposed on either side of the central portion. The extensions 43, 44 have an arcuate shape adapted to a portion of the circumference of the bores in the bearing 9 through which the shafts 7, 8 extend. Sealing means in the form of a joint 45 borders the contour C and ensures hermetic sealing of each chamber 14, 15 between the bearing and the end plate. The balancing means E advantageously comprise auxiliary chambers 46 – 49 (FIG. 4) of circular shape. The auxiliary chambers are isolated from one another and each connected to that face of the bearing which is disposed adjacent the gearwheels via a duct 46*a* – 49*a* respectively perpendicular to that surface of the bearing and extending through the bearing.

Each auxiliary chamber 46 is hermetically sealed by a sealing ring 50 clamped between the end plate and the bearing. The main chambers 14, 15 and the auxiliary chambers 46 are produced directly in the face of the bearing, inter alia by stamping, in the embodiment illustrated in the drawings.

In one variant the chambers might be produced by cutting out openings in an intermediate plate disposed between the end plate and the bearing.

As shown in FIG. 4, two auxiliary chambers 46, 47; 48, 49 are provided beyond the two ends of the transverse extensions 43, 44 of the main chamber. The chambers 46, 47 are disposed on either side of the plane P, preferably symmetrically. The same thing applies to the chambers 48, 49.

The auxiliary chambers receive liquid whose pressure is equal to the pressure of the liquid disposed between the teeth of the gearwheel from the opposite side of the bearing. The force delivered by the liquid pressure in the auxiliary chambers therefore enables the hydraulic equilibrium to be completed, because if the main chamber 14 extended as far as the end auxiliary chambers 49, 47, an excessive hydraulic balancing force would be developed since, for the polar angle corresponding to the position of the auxiliary chambers 47, 49, the pressure of the liquid between the teeth of the gearwheels has not yet reached the maximum value corresponding to the delivery pressure.

In cases in which the machine is a motor required to operate in both directions, the machine preferably has two main chambers which are symmetrical to one another in relation to the plane P, so that hydraulic balancing is ensured whatever the direction of rotation of the motor may be. One of the main chambers is used for a particular direction of rotation of the motor.

The drawings show a pump rotating to the left — i.e., the top gearwheel 4 must rotate clockwise, as viewed in FIG. 3.

To have a pump rotating to the right, the following are necessary: pivot the whole of the casing 2 and bearings 9, 10 around the vertical axis lying in the plane P and extending through the centre of the casing 2: mount a stud 42 for positioning the front end plate 3 and the closure members for return of leakages *O* on the right side — i.e., the positioning stud being mounted on the intake side, and the leakage closure members *o* being mounted on the delivery side.

The output of the shaft 7 will still be on the side shown in FIG. 1.

A machine according to the invention is assembled in the following way.

Before the machine is assembled the difference is determined between the axial length $l$ of the shoulder 24 and the axial length $e$ of the gearwheels 5, 6. The difference between $l$ and $e$ determines the total clearance between the faces of the gearwheels and the adjacent faces of the bearings before clamping. The value $l - e$ is generally between 0.07 and 0.11 of a millimeter, with fluctuations corresponding to the machining fluctuations in the width of the shoulder 24 and the width of the gearwheels 5, 6.

The whole of the machine is then assembled. The screws 25 are given a preliminary tightening which is inadequate to cause any substantial resilient deformation of the shoulder 24. Then measuring devices are installed, such as a micrometric comparator, to follow the axial displacement of the shaft 7 in relation to the front plate 3. The four screws 25 are then tightened, with the same torque, causing a displacement of the bearings 9, 10 corresponding to a reduction in the axial clearance. A reduction of the width $l$ of the shoulder 24 corresponds to a displacement $\delta$. The axial clearance between the faces of the bearings and the gearwheels is $j = l - e$ before clamping. Tightening will be such that the clearance $j'$, after tightening, becomes at most equal to the limit $h$:

$$j' \leqq h$$

From this the minimum value of the displacement $\delta$ of the shaft 7 to be ensured is deduced.

Tightening is carried out until this value of the displacement $\delta$ is reached and indicated by the micrometric comparator. As a rule the assembly is so devised that the displacement of the shaft 7 to be measured during the tightening of the screws 25 is of the order of 30 to 40 $\mu$ (three hundredths to four hundredths of a millimeter).

As a result of the invention there is no longer any need to carry out an always troublesome matching between the casings 2 and gearwheels 5, 6 so as to obtain between the faces of the bearings and those of the gearwheels an operational clearance lower than the limit $h$.

Machining fluctuations are to some extent compensated for by taking action on the tightening of the screws 25, producing a varying degree of compression of the shoulder 24.

The invention therefore enables an optimum axial operational clearance to be ensured to obtain a satisfactory volumetric output, even at elevated pressures.

Since the end plates 3, 4 are strictly applied to the bearings 9, 10 by the screws 25 during assembly, no particular anti-extrusion system need be provided for the joints 45, 50 enclosing the main and auxiliary hydraulic balancing chambers.

Such rigorous application of the bearings to the internal shoulder of the casing prevents small displacements thereof which cause wear.

I claim:

1. A volumetric machine comprising:

a tubular casing having first and second axial ends, said casing having an inlet and outlet for working fluid;

first and second end plates closing said first and second casing ends respectively;

first and second rigid bearings received in said casing adajcent said first and second end plates respectively;

first and second meshing gearwheels each received in said casing between said first and second bearings; and means for balancing each of said first and second bearings, said balancing means comprising a chamber defined between each said bearing and said adjacent end plate and means for admitting to each said chamber a fluid at a pressure increasing with a working pressure of said working fluid; said casing having an internal shoulder between said bearings, said shoulder having an axial length to limit the axial distance between the proximate faces of said bearings to a value greater than the axial length of each said gearwheel; in which machine the improvement comprises:

means for mechanically clamping said shoulder of said casing between said bearings and said end plates; said shoulder having an axial length in an unclamped condition thereof such that the difference between said axial length of said shoulder and said axial length of each said gearwheel is greater than a predetermined axial operating clearance between said gearwheel and said bearings; said clamping means exerting on said shoulder in the clamped condition thereof in the normal operating condition of the machine a force resiliently deforming said shoulder so that said difference is reduced to a value at most equal to said operating clearance, the axial length of the casing being such that, after the shoulder has been clamped between the bearings, a clearance is left between each end face of the casing and the adjoining end plate.

2. A machine as claimed in claim 1, wherein said difference between said axial length of said shoulder in the unclamped condition thereof and said axial length of each said gearwheel is at least equal to 7 hundredths of a millimeter, said predetermined axial operating clearance being of the order of three hundredths to four hundredths of a millimeter.

3. A machine as claimed in claim 1, wherein the maximum amplitude of the forces exerted on said clamping means via said end plates by said working fluid is less than one third of the initial clamping force exerted by said clamping means.

4. A machine as claimed in claim 3, wherein said maximum amplitude is less than one quarter of said initial clamping force.

5. A machine as claimed in claim 1, wherein said clamping means comprises fasteners extending through said end plates, said bearings and said shoulder.

6. A machine as claimed in claim 5, wherein said fasteners comprise four screws, said shoulder comprising four solid zones disposed on either side of said inlet and said outlet of said casing, said shoulder comprising four holes to receive said screws, said holes being formed in said four zones and located at the apices of a rectangle.

7. A machine as claimed in claim 6, wherein said shoulder is formed with first and second circular recesses to receive said first and second gearwheels, said four holes in said shoulder being located as far as possible from said inlet and outlet of said casing whilst maintaining a minimum thickness of material between said holes and said recesses.

8. A volumetric machine as claimed in claim 1 in which each said chamber of said balancing means is a main chamber located on one side of an axial plane of said casing passing through the axes of said first and second gearwheels and said balancing means comprises, moreover, for each of said first and second bearings auxiliary chambers isolated from each other and defined between each said bearing and said adjacent end plate and respective channels extending axially through each said bearing from said auxiliary chambers to the face of said bearing adjacent said gearwheels, at least two auxiliary chambers being located between each said bore of each said bearing and the periphery of said bearing, said auxiliary chambers being located adjacent said axial plane and on respective sides of said axial plane.

9. A volumetric machine, as claimed in claim 8, in which the main chambers and the auxiliary chambers are produced directly in the face of the bearing.

10. A method of making a volumetric machine, said machine comprising:

a tubular casing having first and second axial ends and an internal shoulder; first and second end plates closing said first and second casing ends respectively; first and second rigid bearings received in said casing adjacent said first and second end plates respectively; first and second meshing gearwheels each received in said casing between said first and second bearings;

which method comprises:

providing means for mechanically clamping said shoulder of said casing between said bearings and said end plates; dimensioning the axial lengths of said shoulder and each said gearwheel such that the difference between said axial length of said shoulder in an unclamped condition thereof and said axial length of each said gearwheel is greater than a predetermined axial operating clearance between said gearwheel and said bearings; and actuating said clamping means to clamp said casing shoulder to resiliently deform said shoulder so that said difference is reduced to a value at most equal to said operating clearance, the axial length of the casing being such that, after the shoulder has been clamped between the bearings, a clearance is left between each end face of the casing and the adjoining end plate.

11. A method as claimed in claim 10, said machine further comprising a shaft on which one of said first and second gearwheels is mounted, said shaft extending through one of said first and second end plates, which method includes:

following displacement of said shaft relative to said one end plate during actuation of said clamping means; and controlling the clamping force applied by said clamping means in dependence upon said displacement of said shaft.

* * * * *